US006358090B1

(12) United States Patent
Kuan

(10) Patent No.: US 6,358,090 B1
(45) Date of Patent: Mar. 19, 2002

(54) CHARGER PLUG CONNECTOR

(75) Inventor: Chi-Te Kuan, Shulin (TW)

(73) Assignee: L&K Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 09/687,956

(22) Filed: Oct. 13, 2000

(51) Int. Cl.[7] ..... H01R 13/648
(52) U.S. Cl. ..... 439/607; 439/680; 439/701
(58) Field of Search ..... 439/680, 681, 439/607–610, 701

(56) References Cited

U.S. PATENT DOCUMENTS 4,422,706 A * 12/1983 Neuhouser ..... 439/680
4,611,878 A * 9/1986 Hall et al. ..... 439/680
4,857,016 A * 8/1989 Benscoter et al ..... 439/680
5,417,590 A * 5/1995 Dechelette et al. ..... 439/680
5,549,488 A * 8/1996 Berndt et al. ..... 439/680

* cited by examiner

*Primary Examiner*—Hien Vu
(74) *Attorney, Agent, or Firm*—Pro-Techtor International Services

(57) ABSTRACT

A charger plug connector, comprising: an insulating casing, a terminal unit accommodated in the insulating casing, a conductive terminal assembled to the terminal unit, and an shadowing unit, characterized in that: the terminal unit comprises a foundation and a square accommodating chamber that extends from the foundation, and on the accommodating chamber is a penetrating assembling hole; the shadowing unit enveloping the square accommodating chamber, and between the shadowing and the square accommodating chamber is a location identifying device, such structural characteristics composing a fully innovated structure of plug connector, and the location identifying device serving to ensure correct orientation of the charger plug connector and correct connection with the socket connector.

7 Claims, 6 Drawing Sheets

CHARGER PLUG CONNECTOR

BACKGROUND OF THE INVENTION

1. Field of the Invention

The present invention relates to a plug connector, particularly a charging plug that is used for mobile phone and connection with a charger, with a small size of communication transmission end and protection against misconnection, to provide stable transmission of telecommunication signals.

2. Description of Related Art

Conventionally, a charging slot of a socket connector which is coupled with a plug connector and is projected molding in the socket connector by plastics. To meet the requirement for injection forming, the size of prior art of the socket connector is generally large, and the size of its matching plug connector could not be reduced, so the prior art could not meet the trend for light weight and compactness. In view of that drawback, the applicant has disclosed in R.O.C pending No. 89203120 a structure enabling possible reduction of the height of a charging socket connector, in that case the charging socket connector and a metal shadowing unit and a charging terminal unit combine to shape a frame of square charging insert slot, the frame of metal shadowing unit serving to replace plastic injection molding to effectively reduce its integral height, so that the integral thickness of the assembled mobile phone can be reduced. Moreover, the prior art plug connector still did not meet a convenience for manufacture, which have to get round profile by lathe and get a round inserting hole on the round profile by driller, then to be assemble together with an insulating, a terminal unit and a metal shadowing. Hence, There are expensive to made manufacture the prior art plug connector and could not effectively make high quality.

SUMMARY OF THE INVENTION

It is therefore an objective of this invention to provide an innovative structure with size and configuration completely different from with a round inserting hole of the round profile to effectively reduce the size of contact end and coordinate with a matching socket connector, to meet the trend of design for light weight and compactness.

It is another objective of this invention to provide an innovative structure with protection against misconnection, and ensure correct transmission of communication signals and connection.

More objective of this invention to provide an innovative structure with mating stable for the plug connector and the socket connector are coupled and to facilitate gripping the charger plug connector.

CHARACTERISTICS OF THE INVENTION

The present invention of a charger plug connector comprises: an insulating casing, a terminal unit accommodated in the insulating casing, a conductive terminal assembled on the terminal unit, and an shadowing unit, characterized in that: the terminal unit comprises a foundation and a square accommodating chamber extending from the foundation, and on the accommodating chamber is a penetrating assembling hole; the shadowing unit encompassing the square accommodating chamber. besides, one side of an opposite position of the shadowing unit and the square accommodating are out of the perpendicular, thus to mate with the same way of the socket connector, and ensures correct orientation of the charger plug connector and correct connection with the socket connector.

BRIEF DESCRIPTION OF THE DRAWINGS

The invention can be fully understood by reading the following detailed description of the preferred embodiments, with reference made to the accompanying drawings, wherein.

DETAILED DESCRIPTION OF PREFERRED EMBODIMENTS

Figure 1:
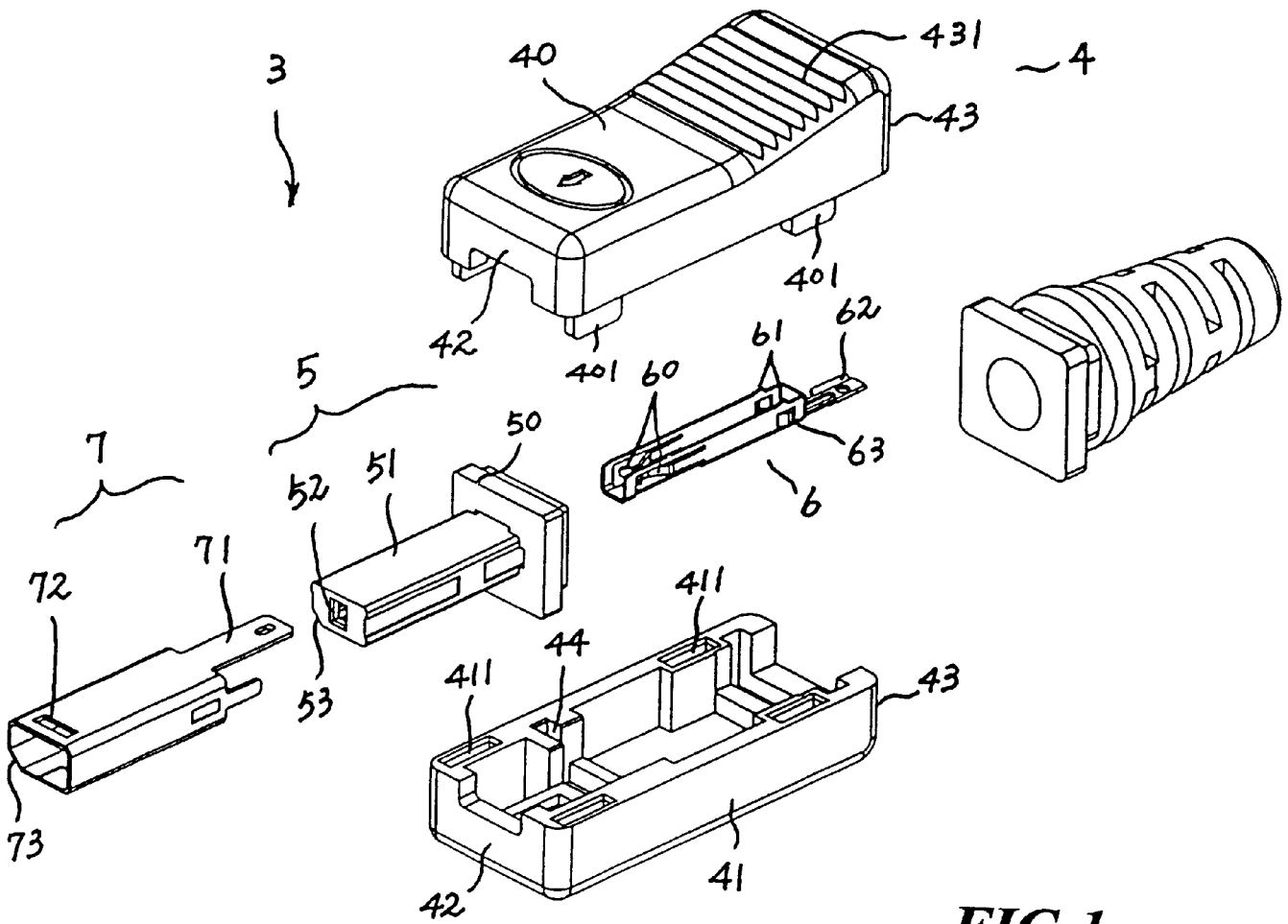
FIG. 1 is a perspective, disassembled view of the invention of charger plug connector.
Figure 2:
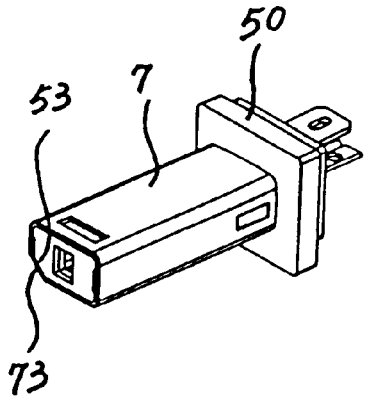
FIG. 2 is a perspective, a part assembled view of FIG. 1.
Figure 3:
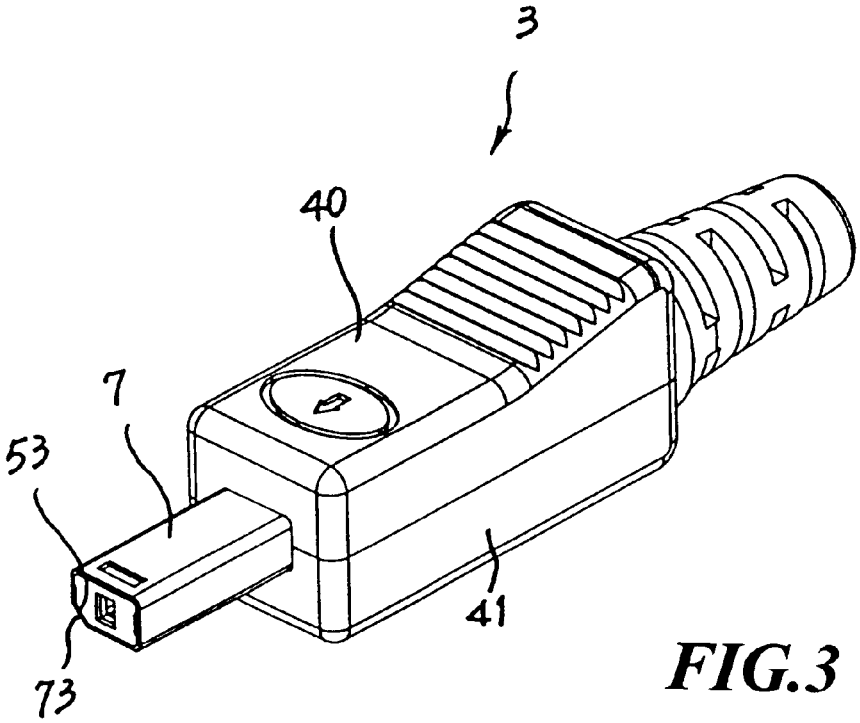
FIG. 3 is a perspective, assembled view of FIG. 1.

As shown in FIG. 1 to FIG. 3, the invention of charger plug connector 3 comprises: an insulating casing 4, a terminal unit 5, a conductive terminal 6, and an shadowing unit 7, wherein, said insulating casing 4 has a first casing 40 and a second casing 41, wherein, on the first casing 40 is a snap post 401, and on the second casing 41 opposite the snap post 401 is a snap groove 411, whereby the two can be fastened as one unit. The first casing 40 and the second casing 41 respectively have corresponding coupling side 42 and connecting side 43, and inside the first and second casings 40, 41 are embedding grooves 44, which serve to assemble and fix the terminal unit 5. On the connecting side 43 of the first casing 40 is a protrusion 431 with a rough surface to facilitate gripping.

The terminal unit 5 is assembled between the first and the second casings 40, 41, comprising a foundation 50 and a square accommodating chamber 51 that extends from the foundation 50, wherein, the foundation 50 is located at the connecting side 43 of the insulating casing, and the square accommodating chamber 51 is located at the connecting side 42 of the insulating casing, and on the accommodating chamber 51 is an assembling hole 52 that penetrates to the foundation 50, serving to accommodate the conductive terminal 6. When the components are assembled, the foundation 50 of the terminal unit 5 is embedded in the embedding groove 44 of the aforementioned first and second casings 40, 41.

Figure 4:
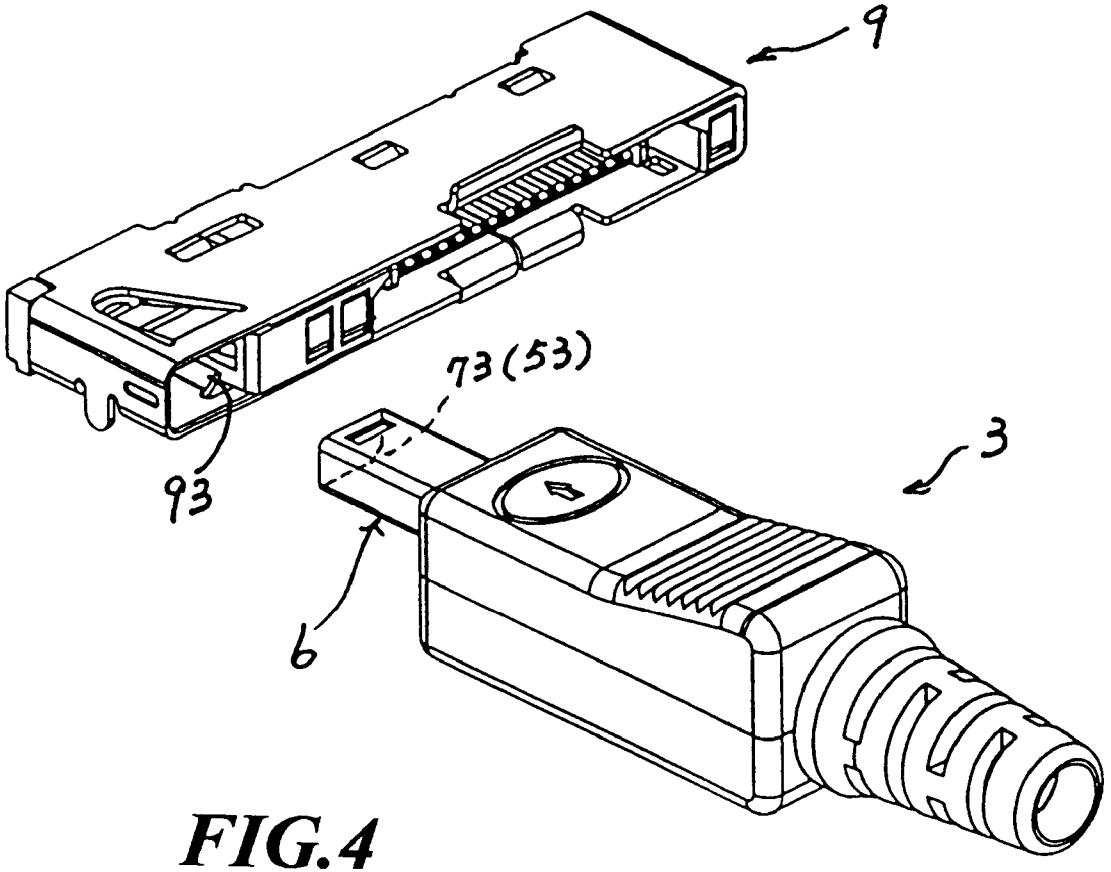
FIG. 4 is a perspective, disassembled view of the invention of charger plug connector and socket connector.
Figure 5:
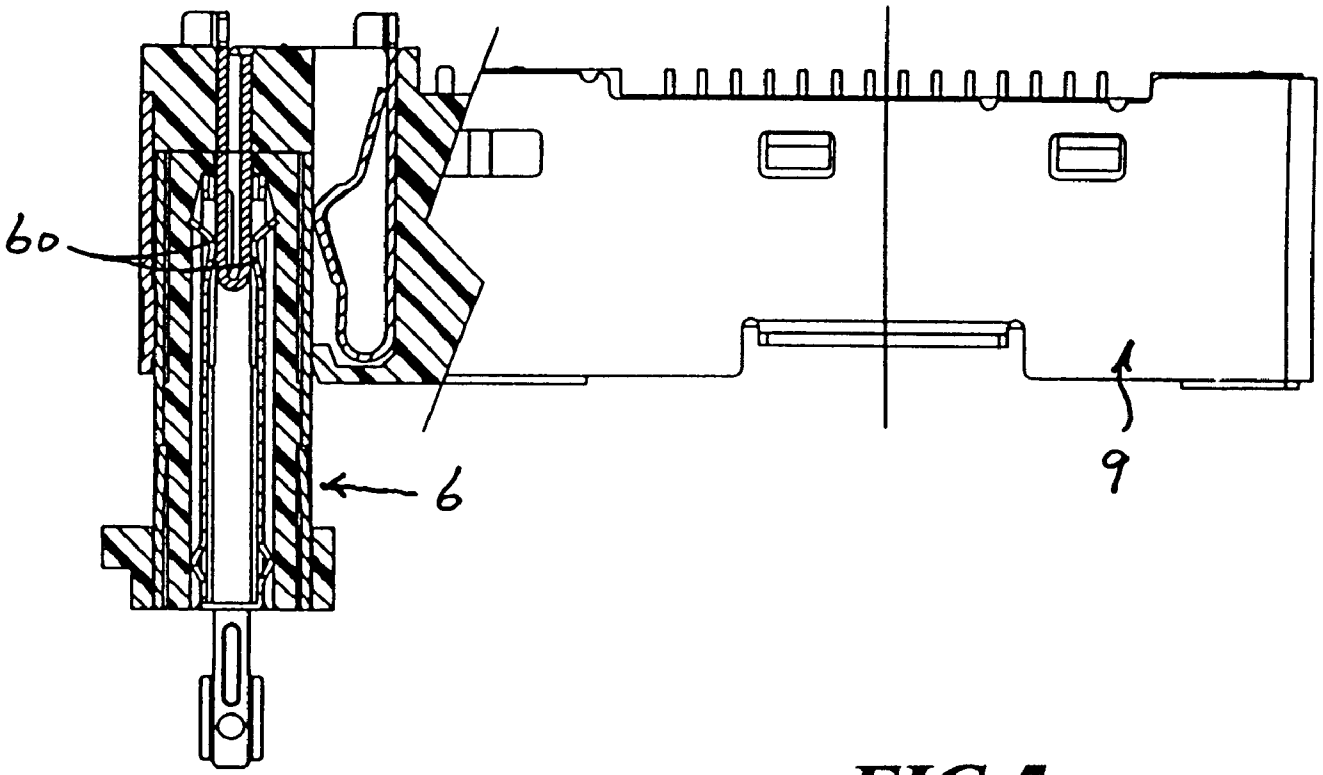
FIG. 5 is a regional section view of FIG. 4.

The conductive terminal 6 is a positive pole for connection, in a U-shape, assembled in the accommodating chamber 5 of the terminal unit 5, having a contact part 60, an interference part 61 and a connecting part 62, wherein the contact part 60 having a clamping strength is punch pressed on the sides of two sides of the U-shape, while the interference part 61 having reversed hooks is on the other sides of two sides of the U-shape, further the two sides of the U-shape respectively having wing 63 for interfere with the assambling hole 52 of accommodating chamber 5. the connecting part 62 is an extension from the U-shape opposite the bottom of the contact part for connection with the power cable. As shown in FIG. 4 and FIG. 5, the contact part 60 of the conductive terminal 6 is located near the assembling hole 52 of the terminal unit 5, and can be clasped with the terminal 90 of a coupling socket connector 9 for communication signals each other.

The shadowing unit 7, covering the square accommodating chamber 51, has hollow two sides opposite the assembling hole 52 of the terminal unit 5, and on one side opposite the foundation 50 of the terminal unit 5 is an extension of a second terminal 71, which serves as the connecting end for a negative pole. On the shadowing unit 7 is a snap opening 72 that can be fastened with a coupling charging socket. Between the shadowing unit 7 and the square accommodating chamber 51 is a location identifying device, which ensures correct orientation of the socket connector and correct coupling of the socket connector. The location identifying device has inclined side 53 on the square accommodating chamber 51, and at the opposite location on the shadowing unit 7 is also inclined side 73.

Figure 6:
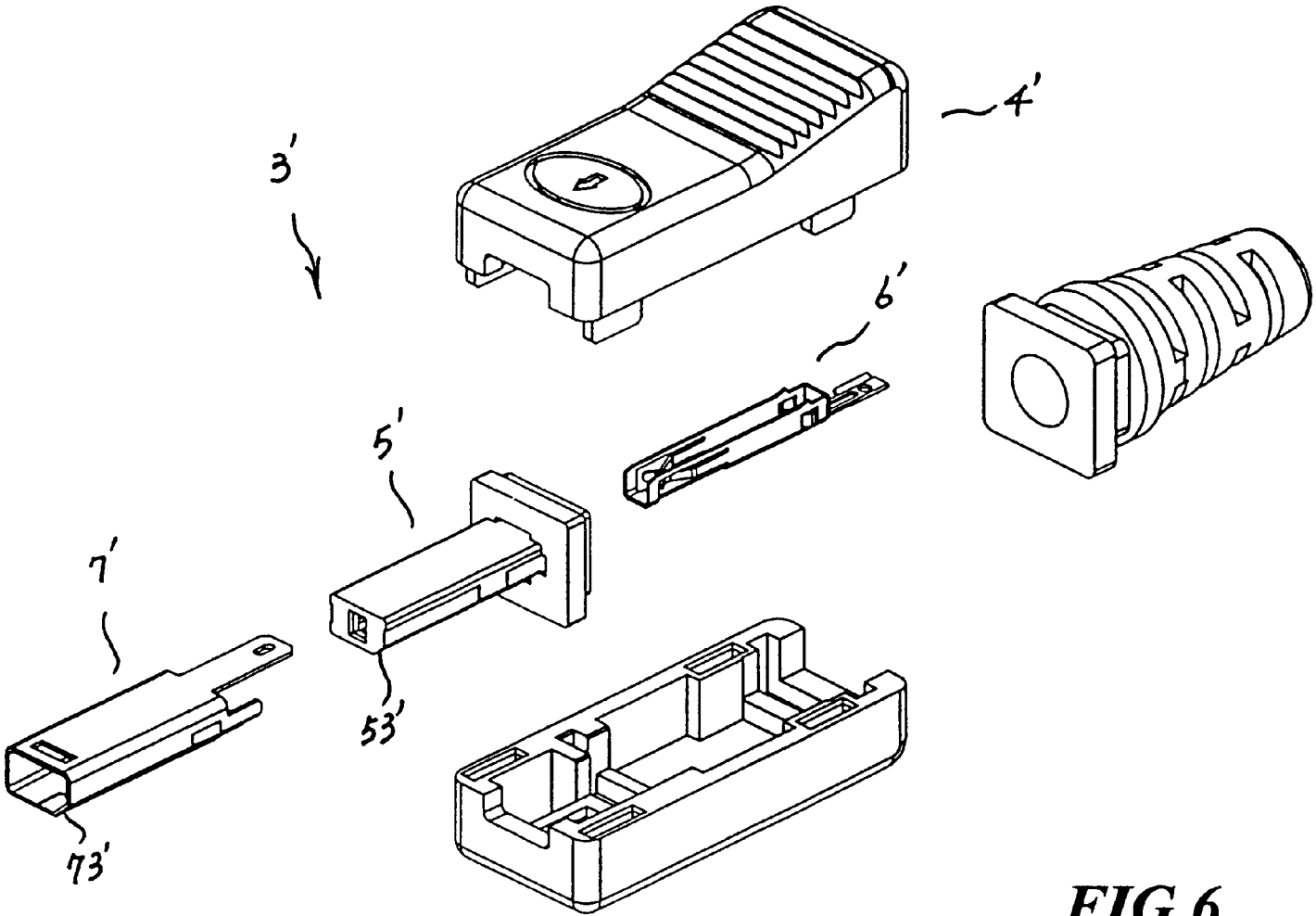
FIG. 6 to FIG. 8 is a perspective, disassembled view of the second embodiment of the invention of charger plug connector, and a part assembled view of FIG. 6, and assembled view of FIG. 6.
Figure 7:
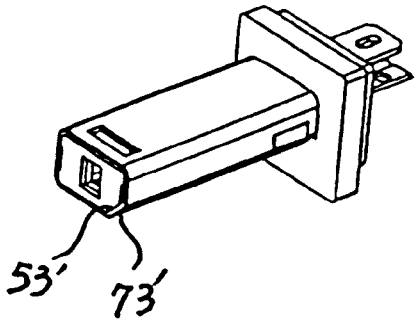
Figure 8:
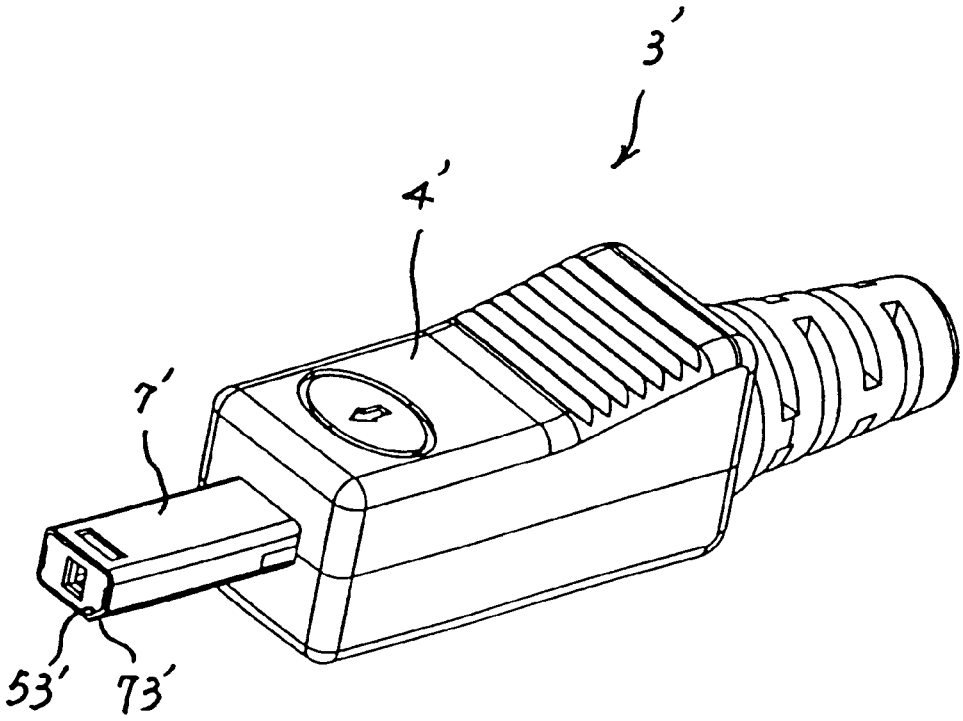

As shown in FIGS. 1–2 and FIG. 3, the invention is assembled by assembling the conductive terminal 6 on the square accommodating chamber 51 of the terminal unit 5, then the shadowing unit 7 is fixed to the accommodating chamber 51 of the terminal unit 5, as show in FIG. 2. then the foundation 50 of the terminal unit 5 is embedded on the embedding groove 44 of the first and second casings 40, 41, and finally the first casing 40 and the second casings 41 are fastened together to become the assembled view shown in FIG. 3. Referring to FIG. 4, the inclined side 53 of the square accommodating chamber 51 and the inclined side 73 of the charge plug connector 3 must be correctly aligned for successful coupling with the location identifying unit 93 on the socket connector 9. Any change of angle will result in failure of connection, therefore, it will prevent misconnection. As shown in FIGS. 6 and 8, which is the second embodiment of the invention of charger plug connector 3, where in a inclined side 53'–73' of location identifying device respectively is located the other side of opposite of the square accommodating chamber 51 and the charge plug connector 3. The other components which are an insulating casing 4', a terminal unit 5', a conductive terminal 6', and an shadowing unit 7' all same the aforementioned first embodiment, so as to ensure firm connection and stable transmission of telecommunication signals.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretations so as to encompass all such modifications and similar arrangements.

What is claimed is:

1. A plug connector in combination with a receiving socket connector comprising:

an insulating casing, said insulating casing comprises a first casing section and a second casing section;

insulative terminal unit assembled between said first casing and said second casing, said terminal unit comprising a foundation and an accommodating chamber extending from said foundation, at least one longitudinal corner of said accommodating chamber has a bevelled area, wherein said foundation is located at a connecting side of said insulating casing and has a sectional area at least twice that of said accommodating chamber, and said accommodating chamber is located at a coupling side of said insulating casing, said accommodating chamber comprises a longitudinal assembling hole that extends from a distal end of said accommodating chamber to said foundation;

a first conductive terminal received in said accommodating chamber of said terminal unit, wherein said first conductive terminal has a U-shaped cross section, a first side of said first conductive terminal comprising a contact part, a top edge of a second side of said first conductive terminal being a reverse hook, and a connecting part extending from a bottom of said first conductive terminal at an end opposite side contact part; and a conductive shadowing unit that receives said accommodating chamber, said shadowing unit comprising a second conductive terminal being formed from one end thereof and being extended through said foundation, wherein at least one longitudinal corner of said shadowing unit has a bevelled area, such that said at least one longitudinal corner of said accommodating chamber must be oriented to coincide with said at least one longitudinal corner of said shadowing unit with said bevelled area to insert said accommodating chamber into said shadowing unit.

2. The plug connector in combination with a receiving socket connector as claimed in claim 1, wherein:

a location identifying means is situated between said shadowing unit and said accommodating chamber, said location identifying means ensuring correct orientation of said plug connector and said socket connector.

3. The plug connector in combination with a receiving socket connector as claimed in claim 2, wherein:

said location identifying means comprises said bevelled areas of said accommodating chamber and said shadowing unit, said bevelled areas mating with an angled ramp in a receiving aperture of said socket connector so that said plug connector can be inserted into said socket connector in one orientation only.

4. The plug connector in combination with a receiving socket connector as claimed in claim 1, wherein:

said first casing and said second casing each have an embedding groove at a position opposite said foundation of said terminal unit, said embedding grooves receiving a rim of said foundation of said terminal unit when said first casing and said second casing are joined together to form said insulating casing.

5. The plug connector in combination with a receiving socket connector as claimed in claim 1, wherein:

said insulating casing has a protrusion at said connecting side to facilitate gripping.

6. The plug connector in combination with a receiving socket connector as claimed in claim 5, wherein:

a surface of said protrusion on said insulating casing is rough so as to enhance friction when said protrusion is gripped.

7. The plug connector in combination with a receiving socket connector as claimed in claim 6, wherein:

said first casing comprises a post, and said second casing comprises a snap groove in a position corresponding to that of said post on said first casing, said post being received in said snap groove when said first casing and said second casing are joined together to form said insulating casing.

* * * * *